US005690102A

United States Patent [19]

Bertheau et al.

[11] Patent Number: 5,690,102

[45] Date of Patent: Nov. 25, 1997

[54] HEAD HARNESS FOR A RESPIRATORY MASK

[75] Inventors: Fernand Bertheau, Plaisir; Patrick Maire, Rambouillet, both of France

[73] Assignee: Intertechnique, Plaisir, France

[21] Appl. No.: 523,832

[22] Filed: May 16, 1990

Related U.S. Application Data

[63] Continuation of Ser. No. 184,479, Apr. 21, 1988, abandoned.

[30] Foreign Application Priority Data

Apr. 22, 1987 [FR] France ..... 87 05682

[51] Int. Cl.[6] ..... A62B 18/08

[52] U.S. Cl. ..... 128/207.11; 128/207.12; 128/205.24

[58] Field of Search ..... 128/207.11, 207.12, 128/205.24; 251/251; 137/38

[56] References Cited

U.S. PATENT DOCUMENTS

| | | | |
|---|---|---|---|
| 3,013,556 | 12/1961 | Galleher, Jr. | 128/207.11 |
| 3,330,274 | 7/1967 | Bennett | 128/207.11 |
| 3,431,931 | 3/1969 | Cupp | 128/207.12 |
| 3,441,020 | 4/1969 | Wortz et al. | 128/207.11 |
| 3,545,722 | 12/1970 | Borio | 251/251 |
| 3,599,636 | 8/1971 | Gutman | 128/207.11 |
| 3,599,639 | 8/1971 | Spotz | 137/205 |
| 3,792,702 | 2/1974 | Delest | 128/207.11 |
| 4,230,097 | 10/1980 | Beaussant et al. | 137/38 |
| 4,437,462 | 3/1984 | Piljay et al. | 128/207.11 |
| 4,664,108 | 5/1987 | Ansite | 128/207.11 |

OTHER PUBLICATIONS

"Eros Quick Donning Mask" by Scott Jul. 1980.

*Primary Examiner*—Aaron J. Lewis
*Attorney, Agent, or Firm*—Larson and Taylor

[57] ABSTRACT

The head harness includes at least one expandable strap whose ends are connected to the mask for constituting a loop. The strap includes an element which is inflatable by pressurized gas for lengthening the strap up to a size sufficient for the user to locate the harness over his head, pressurized gas is supplied to the element for increasing its size upon actuation of a manually controlled valve. Upon release of the valve, the strap contacts the head and maintains the mask. A selection valve authorizes venting of the inflatable element when in an "emergency" position and maintains a residual pressure in the inflatable element when in a "comfort" position.

15 Claims, 4 Drawing Sheets

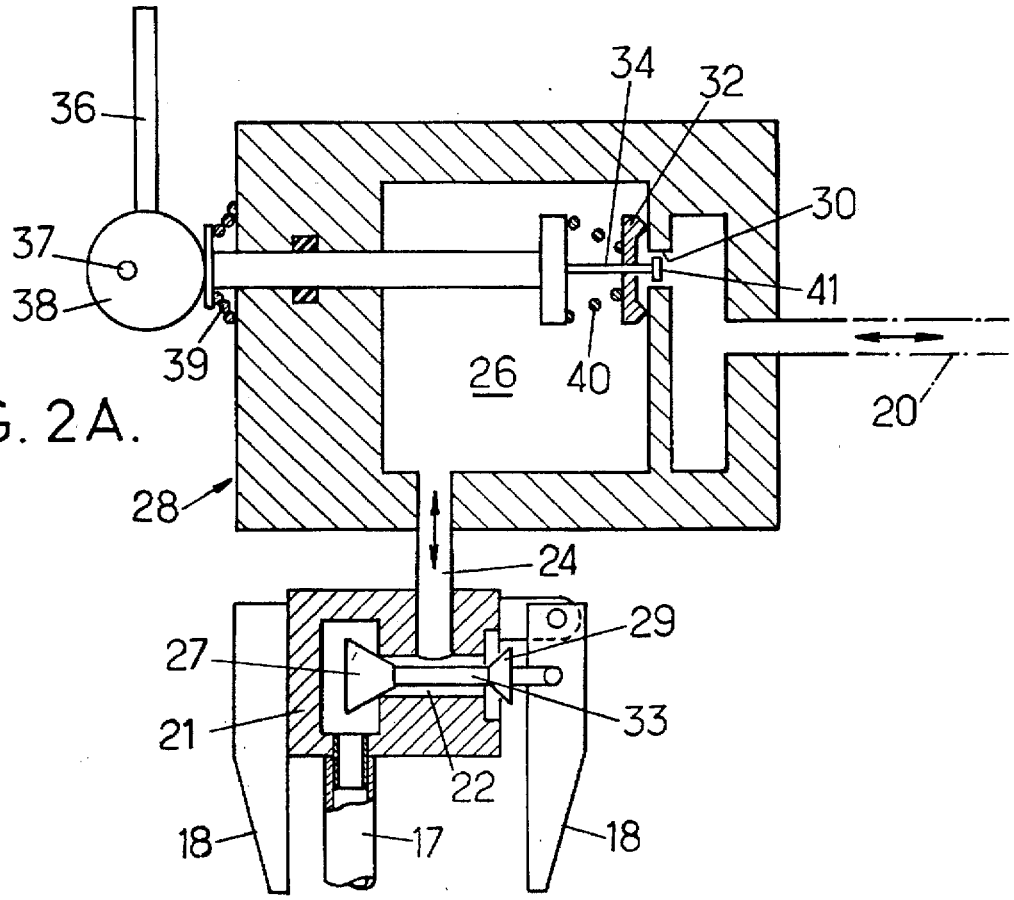
FIG. 2A.
FIG. 2B.
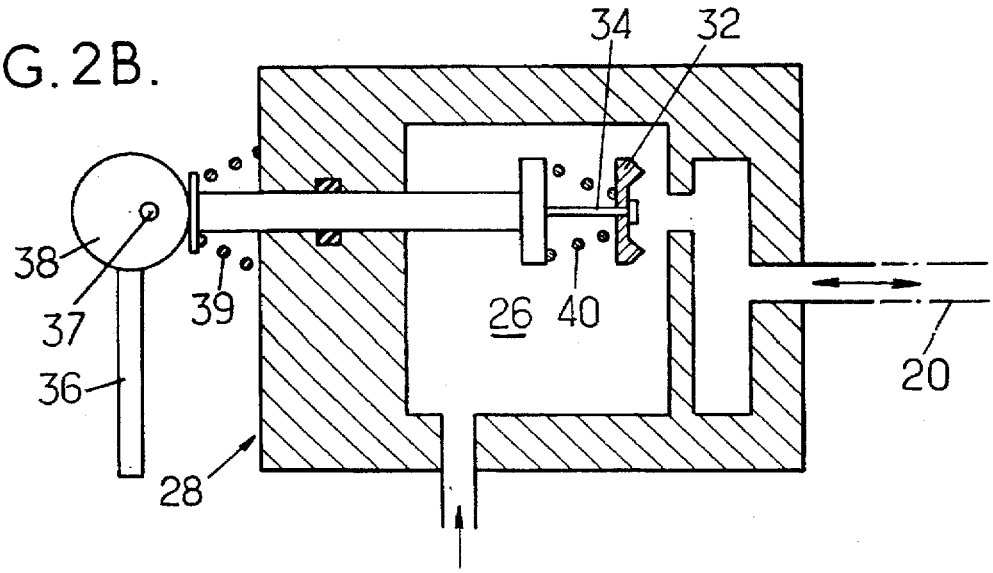

FIG. 3.
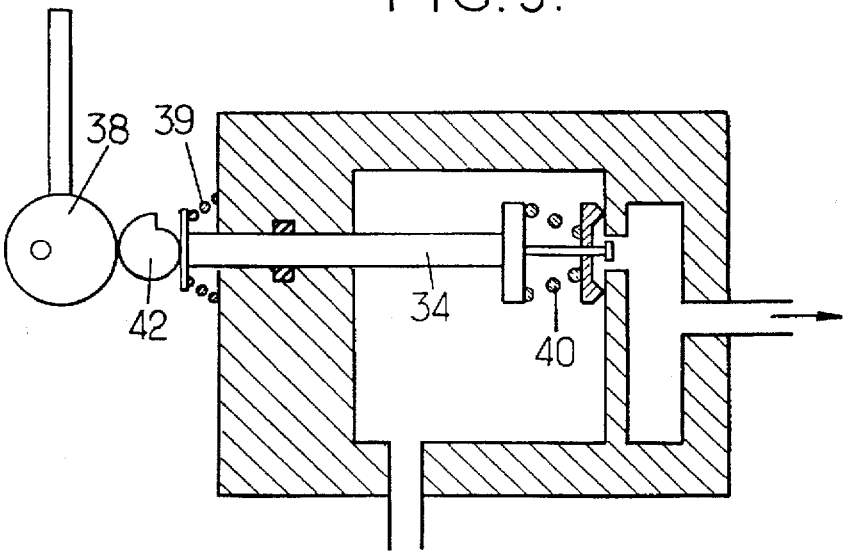
FIG. 4.
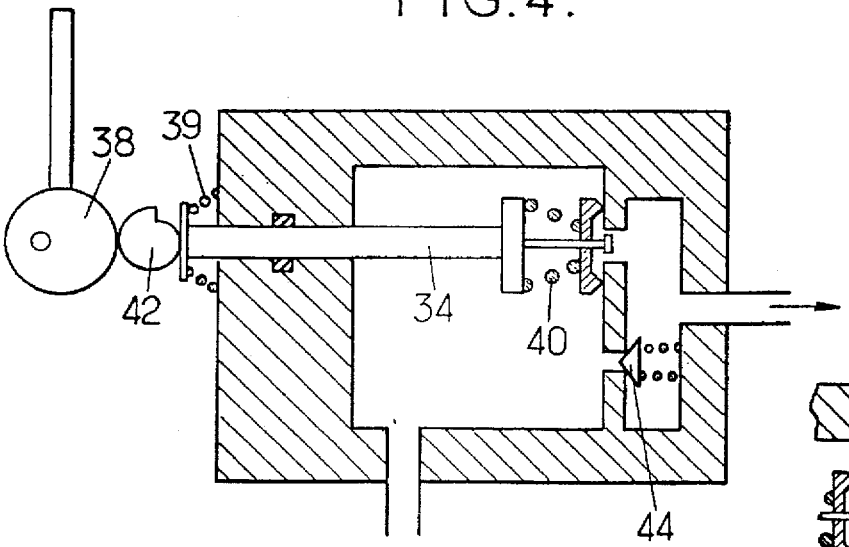
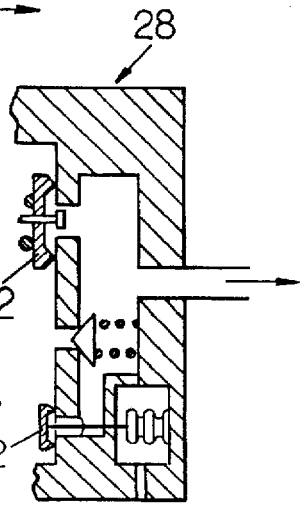
FIG. 4A.

HEAD HARNESS FOR A RESPIRATORY MASK

This application is a continuation of application Ser. No. 07/184,479 filed Apr. 21, 1988, now abandoned.

BACKGROUND OF THE INVENTION

1. Technical Field

The invention relates to head harnesses for fast attachment of a respiratory mask to the head of a user and it is particularly suitable for use by crew members of high altitude aircraft.

As the cruising altitude of passenger and business airplanes increases, it becomes more and more difficult to protect the crew members against a sudden depressurization. However, it is necessary to prevent loss of consciousness of at least one pilot upon depressurization, for him to control the aircraft for return to a safe altitude.

2. Prior Art

Respiratory mask harnesses are known (French 1,506,342 or U.S. Pat. No. 3,599,636; U.S. Pat. No. 4,437,462) which have at least one expandable strap whose ends are connected to the mask and which includes an element which is inflatable by pressurized gas for diametrically enlarging the strap to a predetermined size, sufficient for the user to place the strap around the head. Such harnesses are used on airline planes and include manually controlled means which delivers pressurized gas to the inflatable element for expanding it diametrically upon a positive action and which vents the element upon release for causing the strap to contract, to contact the head and to maintain the mask.

In a typical embodiment, the inflating gas consists of respiratory gas which is delivered to a demand regulator carried by the mask.

Such a head harness may be stored in a box in close proximity to the seat and may be grasped by the user with one hand and donned in a time as short as some seconds. However, if depressurization occurs at a very high altitude, lack of oxygen due to exposure to vacuum during some seconds may be sufficient for causing a delayed temporary loss of consciousness after which it will be too late for the pilot to resume aircraft control.

Such a risk is avoided if the pilot, or one of the pilots, continuously dons his respiratory mask as long as the aircraft is at a high altitude, for instance beyond 10,000 meters. On the other hand permanently donning the mask applied against the face causes fatigue and strain is detrimental to comfort. If the mask is continuously fed with oxygen, the volume of the oxygen bottle stored on-board should be higher than presently required.

SUMMARY OF THE INVENTION

It is a general object Of the invention to provide an improved inflatable head harness of the above-defined type. It is a more specific object to provide a fast donning head harness for respiratory mask which lowers the time period following pressurization failure before respiratory oxygen is available to the user while reducing the inconvenience and loss of comfort ancillary to long time use of the mask held on the face.

For that purpose, there is provided a head harness in which the manually controlled means additionally include a selection valve for optionally venting the inflatable element or maintaining a predetermined residual gas pressure, lower than the full inflation pressure, in the inflatable element.

The selection valve may comprise a pressure holding valve having a control handle with at least two positions. In one of the positions, the valve is subjected to a closure force determining the residual pressure which may be predetermined, adjusted once for all or adjustable. In the last situation, the mask user may adapt the residual pressure to his or her morphology and this is of particular advantage if the same mask is continuously stored in the cockpit for use by individuals of quite variable size.

The pressure holding valve typically has a valve member slidably received on a rod and the control handle has an eccentric cam for moving the rod toward a valve seat and resilient means bias the closure member of the valve toward the seat up to a predetermined position with respect to the rod.

In a typical embodiment, the manually controlled means for inflating the strap cooperate with the selection valve in such a way that, when the selection valve is in a situation where it maintains the gas pressure at said residual value, a slow increase may be caused by actuating the manually controlled means; that makes it possible for the user to re-establish the residual pressure by temporarily acting on the manually controlled means if the force applying the mask over the face increases due to leakage of the inflatable element.

The invention will be better understood from the following description of particular embodiments of the invention, given by way of examples. The description refers to the accompanying drawings.

BRIEF DESCRIPTION OF THE DRAWINGS

FIGS. 2A and 2B are schematic representations of a selection valve of simple structure, respectively in "comfort" and "emergency" positions;

FIGS. 3 and 4, similar to FIG. 2A, illustrate two modified embodiments;

FIG. 4A, similar to a part of FIG. 4, indicates how an altitude responsive valve may be included in the harness.

DESCRIPTION OF PREFERRED EMBODIMENTS

Figure 1:
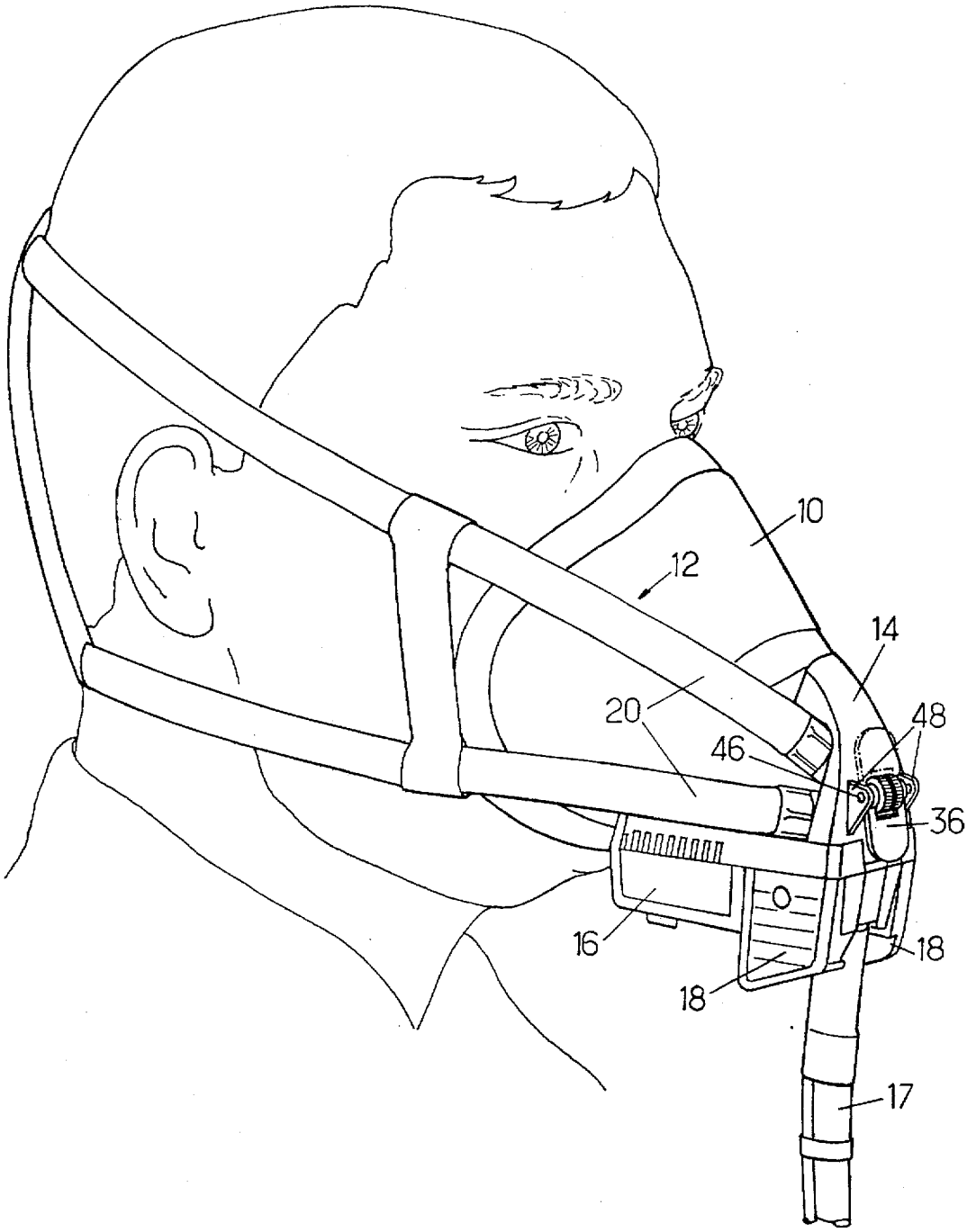
FIG. 1 is an isometric view illustrating the external aspect of a respiratory mask provided with a harness according to an embodiment of the invention.

Referring to FIG. 1, an emergency respiratory apparatus is illustrated in its position of use, when over the head of a user. The apparatus may be considered as having an oro-nasal face cover 10 (which may be provided with goggles for protection against smoke) secured to a rigid connecting block 14, straps 20 for maintaining the face cover 10 applied against the face and attached to the connecting block 14, and a housing 16. The housing contains a (demand regulator) and possible a microphone. The assembly consisting of the straps 20, the connecting block 14 and the elements contained in the block may be considered as a harness 12 carrying the demand regulator and the face cover 1O.

The connecting block is provided with an inlet for connection of a flexible hose 17 communicating with a source of pressurized respiratory gas. The connecting block communicates the regulator with the hose and has manually controlled means for inflating the harness, comprising a control valve for actuation by squeezing two ears 18 carried by the connecting block 14 between the thumb and index finger of the user. One of the ears 18 is rotatable for actuating the valve, as will be shown later.

When the control valve is at rest, it vents an internal volume of the connecting block to atmosphere for permitting retraction of the harness. When the valve is manually actuated, it delivers pressurized gas from the supply hose to the internal volume for harness inflation.

As illustrated in FIG. 1, the harness has two straps 20 each having an inner tube of resilient material contained in a substantially non-stretchable sheath which limits extension of the inner tubes. The length of the inner tubes at rest is such that they are able to apply the face cover 10 onto the face with a pressure sufficient to provide the necessary air-tightness. The invention would however be equally applicable to a harness having one or a plurality of non-stretchable bands, or even a ring, formed to contact the rear of the head and one or more pneumatic jacks for moving the band or ring away from the mask by a sufficient amount for easy donning. Such an arrangement including a band or a ring should be considered as constituting a strap.

According to the invention, the harness has selection valve means which, depending upon its condition either provided an unrestricted communication between the straps and the internal volume of the connecting block or maintains a predetermined over-pressure with respect to the volume when the pressure in the volume decreases to a value lower than the pressure in the straps, typically to the ambient pressure.

Referring to FIGS. 2A and 2B, which illustrate a particularly simple embodiment of the invention, the manually controlled valve means comprises a body 21 defining a chamber 22 which continuously communicates with the internal volume 26 of the selection valve 28. The chamber 22 opens through an opening surrounded by a first valve seat into a space which receives pressurized gas from hose 17. It opens to atmosphere by a passage surrounded by a second seat.

The two seats respectively cooperate with an inlet valve member 27 for admission of pressurized gas to chamber 22 and with a valve member 29 for venting to atmosphere, carried by a same stem driven by the rotatable ear 18. Gas pressure (and possibly the force of a return spring, not shown) biases the movable unit consisting of members 27–29 and stem 33 to the position illustrated in FIG.2A. Then chamber 22 is vented to atmosphere. When the user grasps the harness and squeezes the rotatable ear 18, the movable unit moves (to the left on FIG. 2A), separates chamber 22 from atmosphere and connects it with the pressurized gas supply hose 17.

As illustrated in FIG. 2A, the selection valve 28 is formed with a passage 30 communicating the internal volume 26 with the straps 20, surrounded by a seat for receiving a closure member in the form of a poppet 32. The poppet 32 is slidably received on a rod located coaxially to the seat. A control handle 36 movable by the harness user is drivably connected to the rod and makes it possible to move it between a position closest to the seat (as shown in FIG. 2A) and a position remote from the seat (as shown in FIG. 2B). In the embodiment of FIGS. 2A and 2B, the handle 36 consists of a rotatable lever pivotally received on the housing for rotation about an axis 37 and an eccentric cam 38 having an abutting connection with rod 34. A spring 39 exerting a very slight force retains rod 34 in sliding contact with the eccentric cam. A progressivity spring 40 is located between a flange of rod 34 and poppet 32 and retains the poppet in contact with a stop member 41 on the rod when the rod is in the remote or withdrawn position illustrated in FIG. 2B. The force exerted by spring 40 is in direct relation with the residual pressure in the straps when the rod is in the forward or closest position illustrated in FIG. 2A.

The amount of travel of rod 34 by the eccentric cam 38 is so selected that the poppet 32 is clear of the seat and leaves a free communication between the straps 20 and the volume 26 when the handle is in the "emergency" position illustrated in FIG. 2B for use of the mask upon pressurization failure. On the other hand, the pressure in the straps cannot decrease beyond a value determined by the metering spring 40 and selected for use during extended time periods when the handle is in the "comfort" position illustrated in FIG. 2A before the user releases rotatable ear 18.

The modified embodiment of the harness illustrated in FIG. 3 has a residual pressure adjustment cam 42 located between the eccentric cam 38 and the rod 34. The adjustment cam 42 determines the spacing between the rod and the eccentric cam and consequently determines the compression force of spring 40 when the handle is in the "comfort" position illustrated in FIG. 3.

In the modified embodiment of FIG. 4, a nonreturn check valve 44 having a closure spring of low compression force is arranged for authorizing a gas flow from volume 26 toward the straps if the pressure in volume 26 exceeds the residual pressure in the straps. The non-return check valve 44 may be provided whether or not the selection valve has a residual pressure adjustment cam 42. Due to the provision of non-return check valve 44, the straps can be re-inflated to a predetermined pressure, even with handle 36 in the "comfort" position, if there is a leakage from the straps which progressively decreases the pressure in the latter. For re-inflation, the user gently squeezes the ears 18 until a sufficient pressure is obtained. The non-return check valve 44 preferably has a low cross-sectional flow area for re-inflation to occur slowly. As a result, the straps remain in contact with the head during reinflation and there is no risk of mis-location of the mask. A check valve 44 having a cross-sectional flow area of about 0.05–0.1 $mm^2$ generally gives satisfactory results for a supply pressure of 5 bars.

For avoiding the need for manual actuation upon failure of pressurization when the handle is in the "comfort" position, the device of FIG. 4 may additionally include an altitude responsive valve 52 having a valve closure member driven by altitude responsive belows for automatically communicating the internal volume 26 with the straps, as shown in FIG. 4A.

Figure 5:
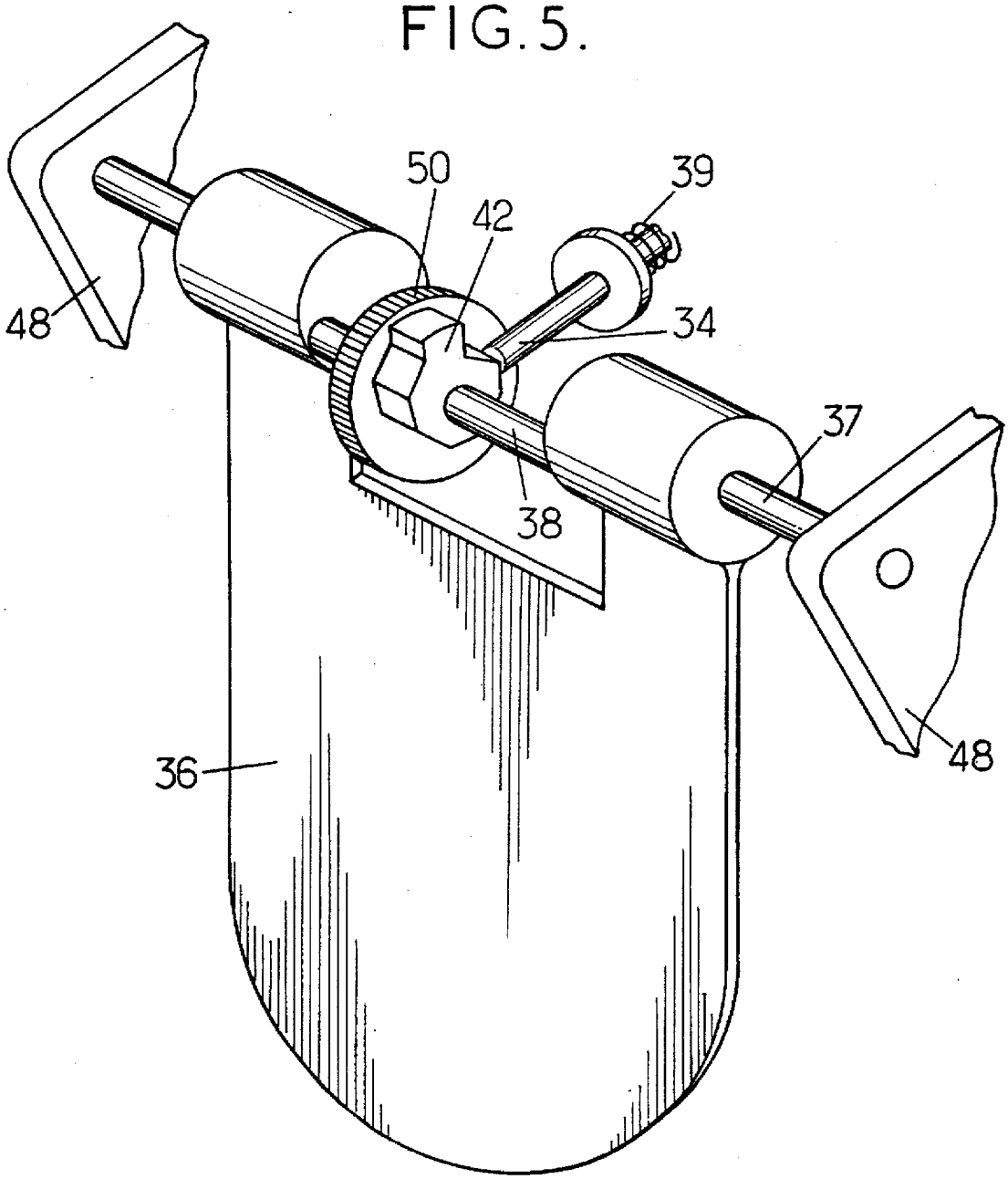
FIG. 5 is an illustration of a possible actual construction of a selection valve according to the representation of FIG. 3.

The actual arrangement of the components of the harness may be as Shown in FIGS. 1 and 5. The manually controlled handle 36 is carried by a U-shape straddle 48 for rotation between a lower position (illustrated in full lines on FIG. 1) and a higher position (in dashdot lines) about axis 27. A stem is carried by handle 36, parallel to axis 37, and at a distance therefrom to constitute the eccentric 38. The residual pressure adjustment cam 42 is carried by stem 38 and has flats for abutting contact with rod 34. The flat sides prevent cam 42 from rotating untimely from the position into which it was manually moved. For easier angular adjustment of the cam 42 by the user, the cam is non-rotatably connected to a knurled wheel 50. The cam is freely rotatable on the eccentrically mounted stem 38 for keeping the same angular position when the stem 38 is rotated about axis 37.

When the mask is not donned, it should be stored with handle 36 in "emergency" condition. If not, it would not be possible to inflate the harness in the embodiments of FIGS. 2A, 2B and 3 and inflation would be slow in the embodiment of FIG. 4. For fulfilling that purpose, the storing box for the emergency respiratory mask may be constructed for mask insertion to be possible only when the control handle 36 is in the "emergency" position. A simpler approach consists of covering that face of the handle which is apparent when in "comfort" position with a contrasting color. Then the reception box should be such that the handle can readily be checked when in storing condition.

The mask may be used as follows.

When the mask is stored for being grasped if emergency conditions occur, the handle 36 is in "emergency" position and operation is identical to that of the prior art harnesses referred to above.

When the mask should be worn for a long time period in stand-by condition, the user removes it from the box. We grasps the ears 18 for inflating the harness and then rotates the handle 36 to "comfort". If the selection valve is of the type illustrated in FIG. 5, the user moves the knurled wheel 50 to the position of maximum residual pressure. He positions the mask on the face and releases the ears. The harness de-inflates until the maximum residual pressure is reached. Then the user adjusts the residual pressure by acting on knurled wheel 50.

If there is a leakage of gas, the tension of the harness progressively increases. If it becomes excessive, the user slightly re-inflates the harness by squeezing the ears until he obtains the appropriate adjustment again.

Then, if there is an incident resulting for instance into depressurization or smoke in the cockpit, while the user is donning the mask in "comfort" position, he just swings handle 36 to "emergency" for causing complete venting of the harness and airtight application of the face cover on the face. Even before airtight contact is achieved, respiratory oxygen is available to the user.

Last, when the user wishes to remove the mask, he first moves the handle to "emergency" and then inflates the harness by squeezing the ears.

It is important to note that, existing masks having a fast donning harness (for instance as described in French 1,506,342 already mentioned) may easily be retrofitted, simply by adding means as illustrated in FIGS. 2 to 5, As a consequence, masks according to the invention and masks for use at lower altitudes may be manufactured with components most of which are common. And existing masks may be adapted to high altitude flight.

We claim:

1. Head harness for respiratory mask having:

at least one expandable strap whose ends are connected to the mask and which has an element inflatable by pressurized gas for lengthening the strap to a predetermined size, sufficient to position it over the head of a user, and manually controlled means having control valve means for optionally admitting pressurized gas up to a complete inflation pressure into said element to when manually actuated to increase said element in size and for venting said element to atmosphere in order to cause the strap to contact the head and to maintain the mask, when released, wherein said manually controlled means further comprises selection valve means in series flow relation with said control valve means which, in one condition, fully vents the inflatable element through said control valve means and, in an another condition, limits said venting and maintains a predetermined residual pressure, lower than the complete inflation pressure in said element.

2. Head harness according to claim 1, wherein said selection closure means includes:

a closure member operatively cooperating with a seat for controlling a passage between said inflatable element and said control valve means, and a manual handle having at least two positions, and operatively connected to said closure member for applying it on said seat with a predetermined force in one of said positions and for moving said closure member clear from said seat in another one of said positions.

3. Head harness according to claim 1, wherein said selection valve means includes:

a passage communicating said inflatable element and an internal volume in continuous communication with said control valve means and surrounded by a valve seat, a handle having at least two predetermined positions, a rod axially movable toward and away from said seat and whose position with respect to said seat is responsive to the predetermined position manually given to said handle, a closure member carried by said rod for movement along said rod, and resilient means carried by said rod and exerting on said closure member a force biasing said closure member toward said seat, said handle and rod being so proportioned that in one of said predetermined positions of the handle the closure member is clear from said seat and in another of said predetermined positions said closure member is applied to said seat with a predetermined force.

4. Head harness according to claim 3, wherein said rod is formed with stop means limiting travel of said closure member on said rod toward the seat with respect to said rod.

5. Head harness according to claim 3, wherein said handle comprises an eccentric cam controlling movement of said rod toward and away from said passage.

6. Head harness according to claim 3, further comprising an angularly adjustable residual pressure control cam operatively located between said handle and stem.

7. Head harness according to claim 6, wherein said residual pressure adjustment cam has flat sides for abutment against the rod and is secured to a rotatable wheel for manual adjustment.

8. Head harness according to claim 1, further including a non-return check valve in parallel flow relation with said selection valve means.

9. Head harness according to claim 1, further comprising an altitude responsive valve for venting said inflatable element upon depressurization.

10. A head harness for a respiratory mask having:

at least one expandable strap whose ends are connected to the mask and which has an element inflatable by pressurized gas for lengthening the strap to a predetermined size, sufficient to position it over the head of a user, and, in a housing, valve means comprising:

a manually actuatable inflation valve having a rest condition into which it is biased by return means, wherein it vents an internal volume of said housing to atmosphere, and an actuated condition wherein it admits pressurized gas from an external source to said internal volume, and a selection valve optionally settable in at least two conditions, constructed to freely communicate said internal volume with said inflatable element in one of its said conditions and to prevent the pressure in said inflatable element from decreasing beyond a predetermined value above the pressure prevailing in said internal volume when in another one of its said conditions.

11. Safety apparatus for use in an airplane or the like comprising:

mask means adapted to be fit against the face of a person and including structure presenting, when so fitted, a chamber adjacent the nose and mouth region of said person for the reception of a breathable gas mixture;

means for delivery of said breathable gas mixture to said chamber, including means operably coupled with said mask means for delivery of pressurized oxygen thereto;

an extensible, inflatable strap element operably connected with said mask means and extendable from a fully deflated position corresponding to a relatively low pressure therewithin which is substantially ambient pressure to a fully inflated position corresponding to full inflation pressure therewithin, and inflation control means operatively interconnecting said oxygen delivery means and said strap element, comprising manually controlled structure for selective inflation of the strap element to said full inflation pressure in order to extend the strap element to said fully inflated position to permit fitting thereof over the head of the person, and for deflation of the element to engage the head of the person to hold the mask in said fitted position, said inflation control means further including inflation level-maintaining means for selectively establishing and maintaining the level of inflation of the strap element at an intermediate gas pressure less than said full inflation pressure and greater than said relatively low pressure, said inflation level-maintaining means having structure for maintaining said intermediate gas pressure within said strap element without manual manipulation of said inflation control means.

12. A respiratory mask-fast donning head harness equipment for use in an airplane, comprising:

a mask having an oro-nasal face cover adapted to be applied against the face of a user and a housing containing a demand regulator and defining, with said face cover, a chamber for the reception of a respiratory gas delivered by a demand regulator, means for delivery of said respiratory gas to said chamber, including means operably coupled with said mask means for delivery of pressurized oxygen thereto, and a demand regulator to form the respiratory gas;

an extensible harness, having inflatable strap means operably connected with said mask and extendable from a fully deflated position corresponding to a relatively low pressure therewithin which is substantially ambient pressure to a fully inflated position corresponding to full inflation pressure therewithin, and inflation control means carried by said face cover, operatively interconnecting said oxygen delivery means and said strap means, comprising a manually controlled structure for selective inflation of the strap means to said full inflation pressure in order to extend the strap means to said fully inflated position to permit fitting thereof over the head of the person, and for deflation of the strap means to engage the head of the person to hold the mask in said fitted position, said inflation control means further including inflation level-maintaining means for selectively establishing and maintaining the level of inflation of the strap means at a residual gas pressure less than said full inflation pressure and greater than said relatively low pressure, said inflation level-maintaining means being arranged for maintaining said residual gas pressure within said strap means without manual manipulation of said inflation control means.

13. Safety apparatus for use in an airplane or the like, comprising:

mask means adapted to be fit against the face of a person and including structure presenting, when so fitted, a chamber adjacent a nose and mouth region of said person for the reception of a breathable gas mixture;

means for delivery of said breathable gas mixture to said chamber, including means operably coupled with said mask means for delivery of pressurized oxygen thereto;

an extensible, inflatable strap element operably connected with said mask means; and inflation control means operatively interconnecting said oxygen delivery means and said strap element for selective, oxygen flow induced shifting of the strap element between an extended position permitting ready donning of the mask and retracted position wherein the strap element tightly engages the head of said person and the mask means is caused to tightly engage the wearer's face, said inflation control means further including comfort control structure for selectively establishing and maintaining the strap element at an intermediate pressure between the pressure therein at said extended and retracted positions thereof wherein the pressure exerted by the strap element against the wearer's head is lessened as compared with the pressure exerted thereby in said retracted position, said comfort structure having means for maintaining said intermediate strap pressure without manual manipulation of said inflation control means.

14. Apparatus as set forth in claim 13, said comfort control structure including means for selectively establishing and maintaining said strap element at any one of a number of intermediate pressures.

15. Apparatus as set forth in claim 13, said mask means including structure for covering only the nose and mouth region of the person.

* * * * *